United States Patent [19]

Poston

[11] 4,258,801

[45] Mar. 31, 1981

[54] DUMP VALVE FOR USE WITH DOWNHOLE MOTOR

[75] Inventor: John B. Poston, Houston, Tex.

[73] Assignee: Eastman Whipstock, Inc., Houston, Tex.

[21] Appl. No.: 47,560

[22] Filed: Jun. 14, 1979

[51] Int. Cl.[3] ..... E21B 4/02; E21B 21/10; F16K 15/04; F16K 15/14

[52] U.S. Cl. ..... 175/65; 137/517; 137/843; 166/329; 175/317

[58] Field of Search ..... 137/517, 843; 175/65, 175/107, 317, 318; 166/329, 326, 319

[56] References Cited

U.S. PATENT DOCUMENTS

| | | | |
|---|---|---|---|
| 2,933,136 | 4/1960 | Ayers et al. | 166/284 |
| 3,010,514 | 11/1961 | Fox | 166/284 |
| 3,077,204 | 2/1963 | Bennett et al. | 137/843 |
| 3,367,363 | 2/1968 | Hoffman | 137/517 |
| 3,376,934 | 4/1968 | Willman et al. | 166/284 X |
| 4,108,203 | 8/1978 | Brown | 166/329 X |
| 4,165,764 | 8/1979 | Grandclement | 137/517 X |
| 4,187,061 | 2/1980 | Jürgens | 175/107 X |

*Primary Examiner*—Stephen J. Novosad
*Attorney, Agent, or Firm*—Jennings B. Thompson; Marvin B. Eickenroht

[57] ABSTRACT

A dump valve having a valve seat and a valve member is located in a string of drill pipe above a downhole motor. The dump valve connects the inside of the drill string with the annulus and allows drilling mud to flow freely therebetween when drilling mud is not being pumped through the drill string to operate the downhole motor. The valve member is made of a deformable resilient material such as rubber. It is held away from the valve seat by spacers until the pressure drop across the valve member is sufficient to deform the valve member and move it past the spacers into engagement with the valve seat. When the pressure differential is relieved, the valve member will return to its normal, unstressed shape opening the valve.

7 Claims, 6 Drawing Figures

DUMP VALVE FOR USE WITH DOWNHOLE MOTOR

This invention relates to pressure operated valves generally, and, in particular, to such valves that are located in a drill string above a downhole motor.

This type of valve is commonly called a "dump valve". Dump valves are designed to be either closed or opened by a pressure differential created across the valve by the fluid to be controlled. The usual dump valve employs a sleeve that is urged in one direction by a spring and in the other direction by the differential pressure created by the pressure drop in the fluid flowing through the sleeve. The higher upstream pressure acts on a piston attached to the sleeve moving the sleeve against the spring. This is the type presently being used with downhole motors, particularly motors of the Moyno type.

In this type of downhole drilling motor, the rotor is forced to rotate relative to the stator by the fluid pumped through the motor. The motor is connected to the lower end of the drill string and the rotor drives the bit. There is a considerable pressure drop across the motor when it is operating. When it is not operating, the fluid in the drill pipe cannot flow through the pump in either direction. Thus, fluid cannot flow out of the pipe as the pipe is being pulled out of the hole or into the pipe as the pipe is being run into the hole.

It is for this reason that dump valves are used with this type of motor. The dump valves are normally opened and are located in the pipe string just above the motor. As the pipe is run in the hole, the fluid in the well bore can easily enter the drill pipe and keep the drill pipe full as the pipe is run into the hole. This avoids the problem of having to stop periodically and fill the pipe with drilling fluid from the surface. Conversely, when the pipe is being pulled out of the hole, the mud or drilling fluid in the pipe is free to flow out of the pipe through the dump valve and the pipes does not have to be pulled wet, which is disagreeable to the drilling crew and also wastes drilling fluid.

Therefore, it is an object of this invention to provide an improved dump valve and method of operating a dump valve.

It is a further object of this invention to provide an improved dump valve and method of operating the same that has only one moving part and which does not require a spring to hold it open.

It is a further object of this invention to provide an improved dump valve for use with downhole motors that is closed by differential pressure and which can be adjusted to change the differential pressure required to close the valve.

It is another object of this invention to provide an improved dump valve and method of operating a dump valve wherein the valve member is made of deformable elastomeric material such as rubber and is held away from the valve seat by spacers positioned around the valve seat until the differential pressure across the valve member is sufficient to deform the valve element and force it by the spacers into sealing engagement with the valve seat.

These and other objects, advantages and features of this invention will be apparent to those skilled in the art from a consideration of this specification, including the attached drawings and appended claims.

In the Drawings

Figure 1:
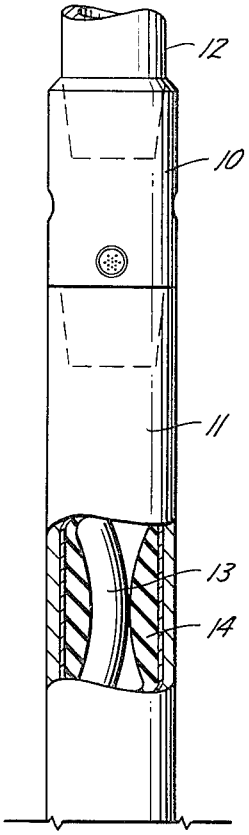
FIG. 1 is a view, partially in section and partially in elevation, of a portion of a pipe string, a dump valve sub, and a portion of a downhole motor of the Moyno type.

Normally, the dump valve in a pipe string is positioned just above the downhole motor. In the portion of the drill string shown in FIG. 1, dump valve sub 10 is positioned just above downhole motor 11 with pipe string 12 extending thereabove. The drill bit is attached to the output shaft of the motor at its lower end. The drilling motor shown in the drawing is of the Moyno type having a solid helical rotor 13 extending through a helical opening in stator 14 which is made of an elastomeric material. Fluid pumped downwardly through the drill pipe and the motor forces the rotor to rotate, which in turn rotates the drill bit.

Figure 2:
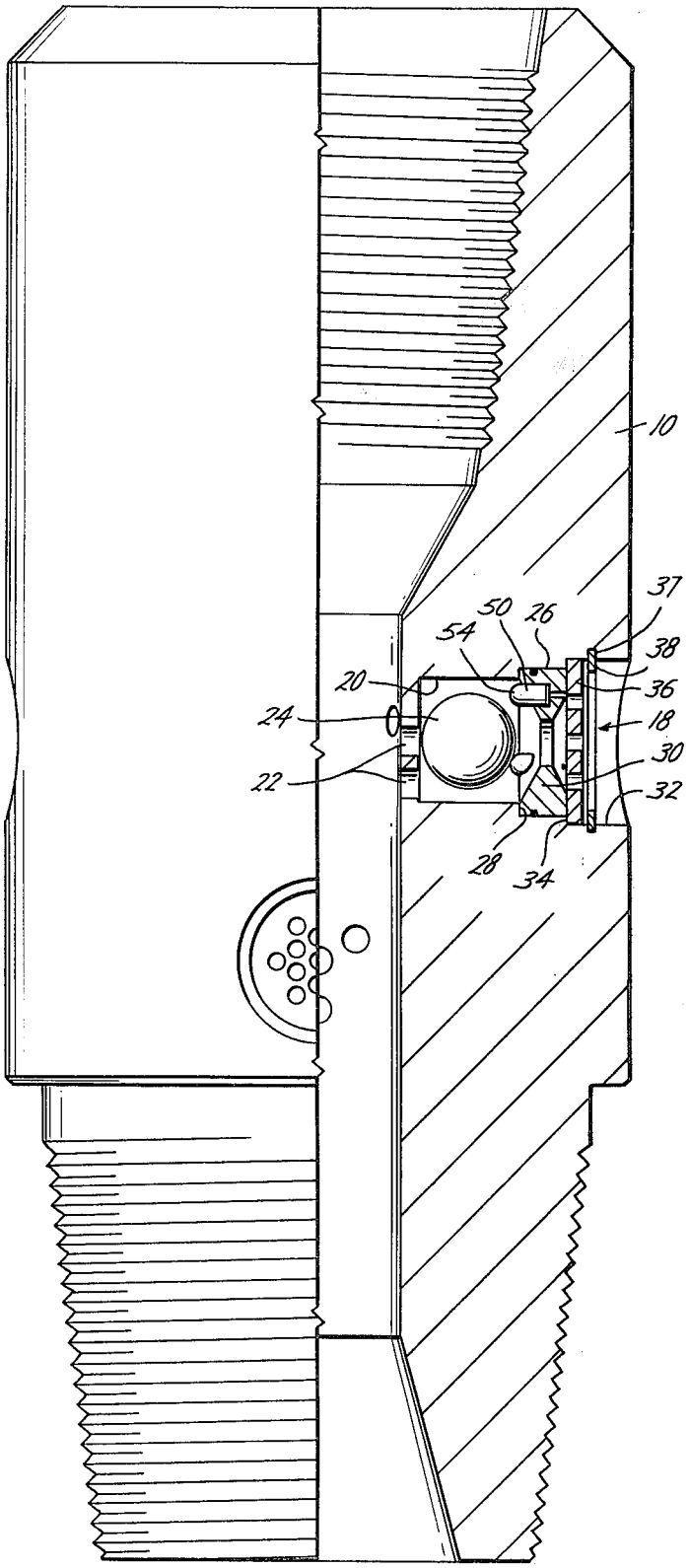
FIG. 2 is a view, partially in section and partially in elevation, of the dump valve sub showing in section the preferred embodiment of the dump valve of this invention.

In the embodiment shown, dump valve sub 10 is provided with four dump valves, each mounted in the side wall of the sub at 90° angles. The dump valves are identical in construction. One is shown in section in FIGS. 2 and 3. The dump valve is located in lateral opening 18 extending through the side wall of sub 10. The opening has three sections of different diameters. Innermost section 20 has the smallest diameter and is the valve member section. It is connected to the inside of the sub by a plurality of drilled holes 22. Located in the valve member section is valve member 24, which consists, in the embodiment shown, of a spherical or ball-shaped member. It is made of deformable material, such as natural or synthetic rubber.

The next section of opening 18 is valve seat section 26. It has a larger diameter than valve member section 20 thereby providing shoulder 28 against which valve seat assembly 30 is positioned. The outermost section of the opening is screen section 32. It is of a larger diameter than the valve seat section thereby providing shoulder 34 to limit the inward movement of screen 36. Internal groove 37 is cut into wall of screen section 32 to receive retainer ring 38, which holds screen 36 and valve seat assembly 30 in position in opening 18.

Valve seat assembly 30 includes disc-shaped valve seat 40. The seat has annular rim 42 and frusto-conically shaped sealing surface 44 that tapers inwardly to opening 46 through the valve seat. The assembly also includes spacers 50. In the embodiment shown, three such spacers are employed. They are cylindrical in cross-section with rounded outer ends 54. The spacers are mounted in holes spaced 120° apart around the opening in the valve seat. The spacers extend outwardly from the sealing surface 44 in the direction of valve member 24. The spacers are positioned to engage spherical or ball-shaped valve member 24 and hold the valve member away from sealing surface 44 of the valve seat. At low volumes of flow, such as when drilling fluid is flowing out of the drill pipe into the annular space around the drill pipe as the pipe is being pulled out of the hole, the fluid can flow freely around valve member 24 and through the valve seat. Conversely, on the way into the hole with the pipe, the fluid can flow freely into the drill pipe through the valve seat and around valve member 24.

When the bit is on bottom and it is desired to operate the downhole motor, the dump valves in sub 10 must be closed to prevent the flow of fluid to the annulus and to force the fluid pumped down the drill pipe to flow through the motor and drive the bit. Spacers 50 are positioned so that as the flow rate through the valve increases as drilling fluid is pumped through the drill pipe, the pressure differential will increase across valve member 24 until it is sufficient to deform the valve member and push it between the spacers into sealing engagement with sealing surface 44 of valve seat 40, closing off opening 46 through the valve seat. As long as this pressure differential exists across the valve member the dump valve will remain closed. As soon as the pumps are stopped and the pressure in the annulus and drill pipe equalize, wall 24 will return to its unstressed, undeformed, spherical shape and out of engagement with the valve seat.

Figure 3:
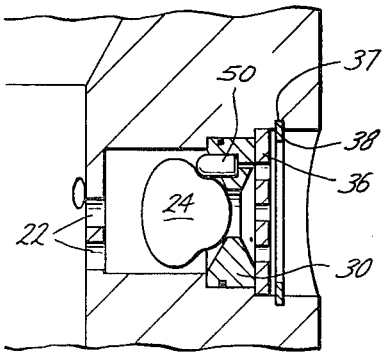
FIG. 3 is a sectional view of the dump valve of FIG. 2 showing the dump valve in its closed position.
Figure 4:
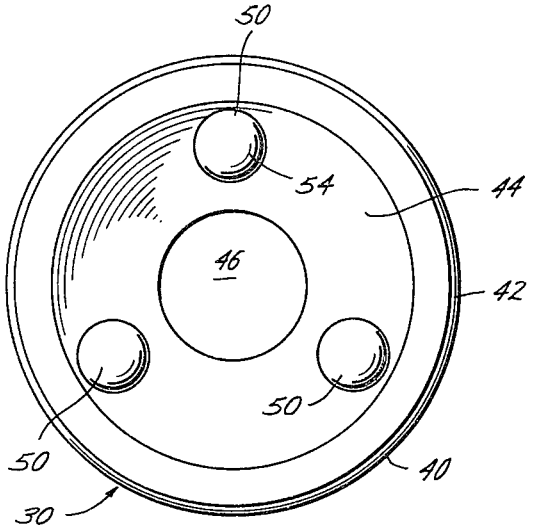
FIG. 4 is a view in elevation of the valve seat of the dump valve of FIG. 2.

As explained above, valve member 24 is deformable and resilient. What is meant is that the valve member is made of material that can be deformed but has memory, such as rubber, either synthetic or natural. Preferably, the spacers will be located and the diameter and elasticity of valve member 24 will be such that when it is forced into sealing engagement with the seat as shown in FIG. 3, the stress that deforms the valve member does not exceed the elastic limit of the material. The valve member then will return to its original shape without undue damage when the pressure drop across the valve member is relieved.

Figure 5:
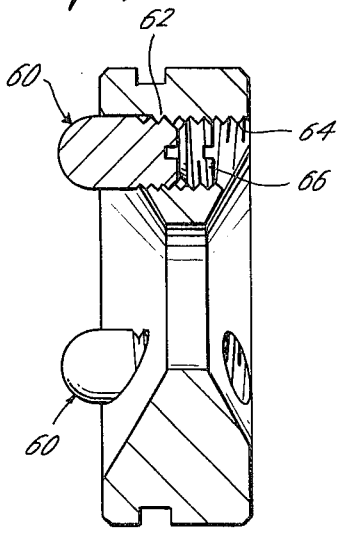
FIG. 5 is a sectional view through a valve seat of an alternate embodiment of the dump valve of this invention.

In accordance with one feature of this invention, the force required to close the valve—i.e., the pressure drop across the valve member required to force it between the spacers or holding members can be adjusted. In the embodiment shown in FIG. 5, spacers 60 are provided with threads 62 for engaging tapped hole 64. By rotating the spacers the distance the spacers extend away from the valve seat can be adjusted. Once adjusted, lock nut 66 will hold the spacers in the desired position.

Generally, the farther the valve member is held away from the seat the higher the pressure differential required to deform it into sealing engagement with the seat. Other factors also affect the pressure drop required, such as the durometer of the elastomeric material used for the valve member and the number and location of the spacers.

Figure 6:
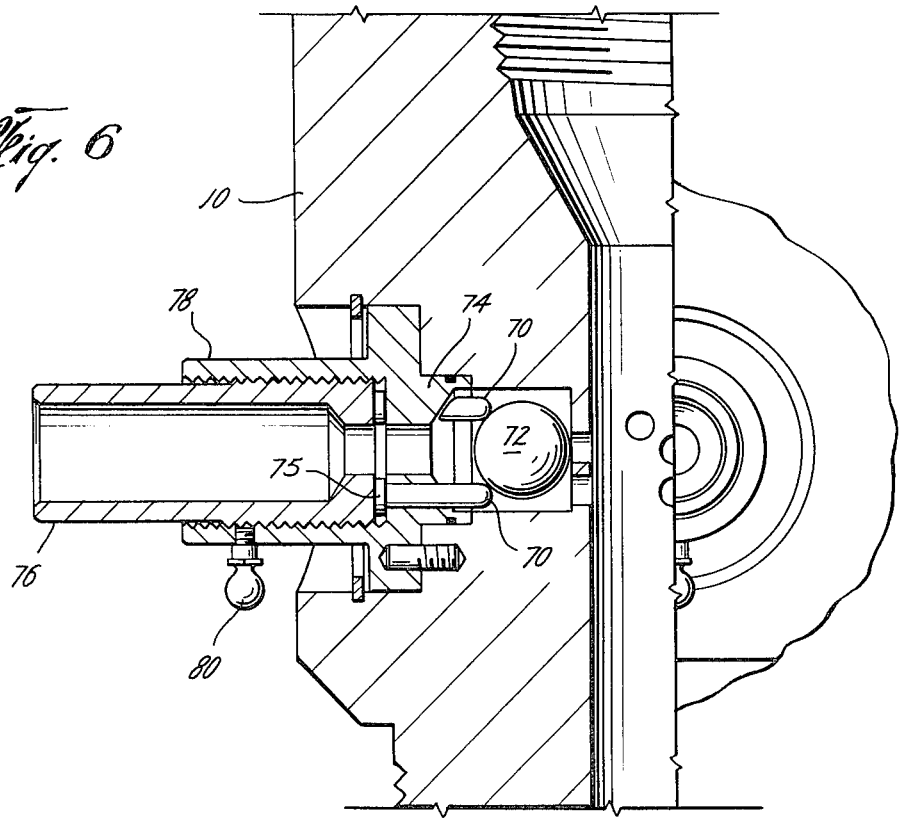
FIG. 6 is a view, partially in section and partially in elevation, of another alternate embodiment of the dump valve of this invention.

FIG. 6 shows an alternate embodiment of the dump valve of this invention with adjustable spacer members. As shown spacer members 70 are holding valve member 72 the maximum distance away from valve seat 74. The spacers in this embodiment are also elongated cylindrical rods having rounded outer ends. These spacers also have flanges 75 on the other end. The spacers extend through openings provided therefor in the valve seat and the flanges limit the distance these spacers can move through openings. Holding spacers 70 against movement away from valve member 72 is cylindrical sleeve 76. Valve seat 74 has tubular section 78 that is provided with internal threads to engage the threads on the outside surface of cylindrical sleeve 76. By rotating the sleeve it can be moved into and out of cylindrical section 78 and adjust the distance that spacers 70 extend beyond the valve seat surface. This in turn will adjust the pressure drop required across valve member 72 to force it into sealing engagement with the sealing surface of seat 74. Set screw 80 holds adjusting sleeve 76 in position after the spacers have been adjusted to the desired height or distance above the valve seat.

In the practice of the method of operating a dump valve in accordance with this invention, the valve member is held away from the valve seat in such a manner that it can deform sufficiently due to the type of the material from which it is made and the differential pressure across it to engage the valve seat and close off the opening through the valve seat. The diameter of the valve member and the diameter of the lateral opening in which it is located must be such that fluid flowing through the opening due to the pumping of drilling fluid through the drill pipe will create a sufficient pressure drop across the valve element to cause the desired deformation and the sealing off of the valve seat.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A dump valve for use with a downhole motor comprising a tubular member for connecting into a drill string above a downhole motor, said tubular member having an opening extending laterally through the side wall thereof, a valve seat mounted in the opening through which fluid can flow into and out of the tubular member, a deformable valve member of resilient material positioned in the opening for movement toward the valve seat by fluid flowing out of the tubular member, and means for holding the valve member spaced from the valve seat to allow fluid to flow out of the tubular member until the differential pressure across the valve member forces the valve member to deform sufficiently to move past the holding means into engagement with the valve seat.

2. The dump valve of claim 1 in which the valve member is spherical.

3. The dump valve of claim 1 in which the valve member holding means includes a plurality of spacer members arranged around the opening in the valve seat and extending outwardly therefrom to engage the valve member and hold the valve member away from the seat.

4. The dump valve of claim 3 in which the distance the spacer members extend from the seat is adjustable to vary the differential pressure required to force the valve member into engagement with the seat.

5. A method of controlling the flow of drilling mud into and out of a pipe string through a valve seat positioned in a lateral opening in the pipe string comprising holding a deformable valve member spaced from the valve seat when no drilling mud is being pumped through the pipe string to allow drilling mud to freely flow into and out of the pipe string as the pipe string is lowered in and pulled out of a well bore and creating a sufficient pressure drop across the deformable valve member when drilling mud is being pumped through the pipe string to deform the valve member sufficiently to move past the spacers into sealing engagement with the valve seat to close the lateral opening to the flow of drilling mud from the pipe string.

6. A method of controlling the flow of fluid through a passageway located in a pipe string in a well bore comprising the steps of positioning a valve seat in the passageway having a port through which fluid can flow, placing a valve member of deformable resilient material in the passage for movement toward the seat by fluid flowing through the passageway around the valve member toward the valve seat, locating spacers between the valve seat and the valve member of deformable resilient material to keep the valve member from being moved into sealing engagement with the valve seat until it deforms under fluid pressure-imposed stress below its elastic limit to move past the spacers into engagement with the valve seat and close the port therethrough until the fluid pressure-imposed stress is reduced sufficiently for the resiliency of the valve member to return it to its original shape spaced from the valve seat by the spacers.

7. A method of providing a lateral passageway in a drill string above a downhole fluid-powered drilling motor that is open when the motor is not operating to allow fluid to flow into and out of the drill string when the drill string and drilling motor is being run into and out of a well bore and is closed when fluid is being pumped down the drill string to operate the drilling motor comprising the steps of positioning a valve seat in the passageway having a port through which fluid can flow, placing a valve member of deformable resilient material in the passage for movement toward the seat by fluid flowing through the passageway around the valve member toward the valve seat, locating spacers between the valve seat and the valve member to keep the valve member from being moved into sealing engagement with the valve seat until it deforms under fluid pressure-imposed stress below its elastic limit to move past the spacers into engagement with the valve seat and close the port therethrough until the fluid pressure-imposed stress is reduced sufficiently for the resiliency of the valve member to return it to its original shape spaced from the valve seat by the spacers.

* * * * *